United States Patent [19]

Losa et al.

[11] Patent Number: 4,625,652

[45] Date of Patent: Dec. 2, 1986

[54] TWO-AXLED CENTRAL SUPPORT BOGIE FOR RAILWAY AND TRAMWAY VEHICLES WITH TWO OR MORE ARTICULATED BODIES

[75] Inventors: PierAntonio Losa, Pianezza; Augusto Tabbia, Settimo Torinese, both of Italy

[73] Assignee: Fiat Ferroviaria Savigliano S.p.A., Italy

[21] Appl. No.: 708,256

[22] Filed: Mar. 5, 1985

[30] Foreign Application Priority Data

Nov. 2, 1984 [IT] Italy ..... 68091 A/84

[51] Int. Cl.[4] ..... B61D 17/20

[52] U.S. Cl. ..... 105/4.1; 105/8.1; 105/199.1; 105/201; 105/171; 280/403

[58] Field of Search ..... 105/4 R, 3, 175, 167, 105/8 R, 9, 4 A, 171, 199 R, 199 A, 199 C, 200, 201, 453; 280/403

[56] References Cited

U.S. PATENT DOCUMENTS

| | | | |
|---|---|---|---|
| 1,480,635 | 1/1924 | Putnam | 105/4 R X |
| 2,168,630 | 8/1939 | Schiff | 105/197 T |
| 2,647,470 | 8/1953 | Mac Veigh | 105/4 R |
| 2,874,647 | 2/1959 | Candlin, Jr. | 105/167 |
| 3,513,592 | 7/1967 | Ernst | 105/4 R X |
| 3,687,085 | 8/1972 | Newman et al. | 105/167 X |
| 3,690,271 | 9/1972 | Hobbs | 105/4 R X |
| 4,405,143 | 9/1983 | Rosenkrands | 105/8 R X |
| 4,411,201 | 10/1983 | Hassel et al. | 105/8 R |
| 4,579,063 | 4/1986 | Losa et al. | 105/8 R |

FOREIGN PATENT DOCUMENTS

| | | | |
|---|---|---|---|
| 424852 | 11/1964 | Switzerland | 105/8 R |

*Primary Examiner*—Robert B. Reeves
*Assistant Examiner*—Glenn B. Foster
*Attorney, Agent, or Firm*—McCormick, Paulding & Huber

[57] ABSTRACT

A two-axled central support bogie for railway and tramway vehicles with two or more articulated bodies includes two cross members carrying the wheels, and a central longitudinal structure the ends of which bear on two air springs carried by respective central platforms formed by the cross members. The central structure carries means for its articulated connection with the articulation ends of the vehicle bodies, and the bogie also includes tie means for connecting the central structure with one of the cross members to prevent movements in a longitudinal direction and lateral resistance means for limiting movement in a transverse direction.

7 Claims, 3 Drawing Figures

TWO-AXLED CENTRAL SUPPORT BOGIE FOR RAILWAY AND TRAMWAY VEHICLES WITH TWO OR MORE ARTICULATED BODIES

The present invention relates generally to railway and tramway vehicles with two or more articulated bodies, and is particularly concerned with a support bogie for fitting to the central part of such a vehicle, that is, beneath the articulation between the two bodies.

The object of the present invention is to provide a bogie having a height which is as limited as possible in order to allow the vehicle to which it is fitted to have a low standing platform even in correspondence with the bogie, and having at the same time a relatively simple and light structure so as to allow considerable relative vertical movements between the wheels and ensure the correct negotiation of crooked and irregular tracks under all conditions.

According to the invention, this object is achieved by virtue of the fact that a two-axled central support bogie for railway and tramway vehicles with two or more articulated bodies is characterised in that it comprises:

- two cross members with upwardly projecting ends which carry respective pairs of idle wheels, the cross members forming respective central platforms each carrying a bellows-type air spring for vertical and transverse suspension,
- two longitudinal members each of which is rigidly connected at one end to one end of a respective cross member and is articulated at its other end to the corresponding end of the other cross member.
- a central longitudinal structure the ends of which bear on the two air springs and carry means for its articulated connection with the articulation ends of the two bodies of the vehicle, the articulated connection means being housed at least substantially within the air springs,
- tie means connecting the longitudinal structure with at least one of the cross members so as to prevent movement in a direction longitudinal of the structure, and
- lateral resistance means for limiting movement of the central longitudinal structure in a transverse direction.

According to the invention, the central longitudinal structure has downwardly projecting parts in the form of upwardly-open holders at its ends, each holder housing a ball-joint coupling member within which a downwardly-projecting articulation pin carried by the articulation end of the corresponding vehicle body is engaged.

An elastic vertical bumper is conveniently fitted to the bottom of each holder.

Figure 1:
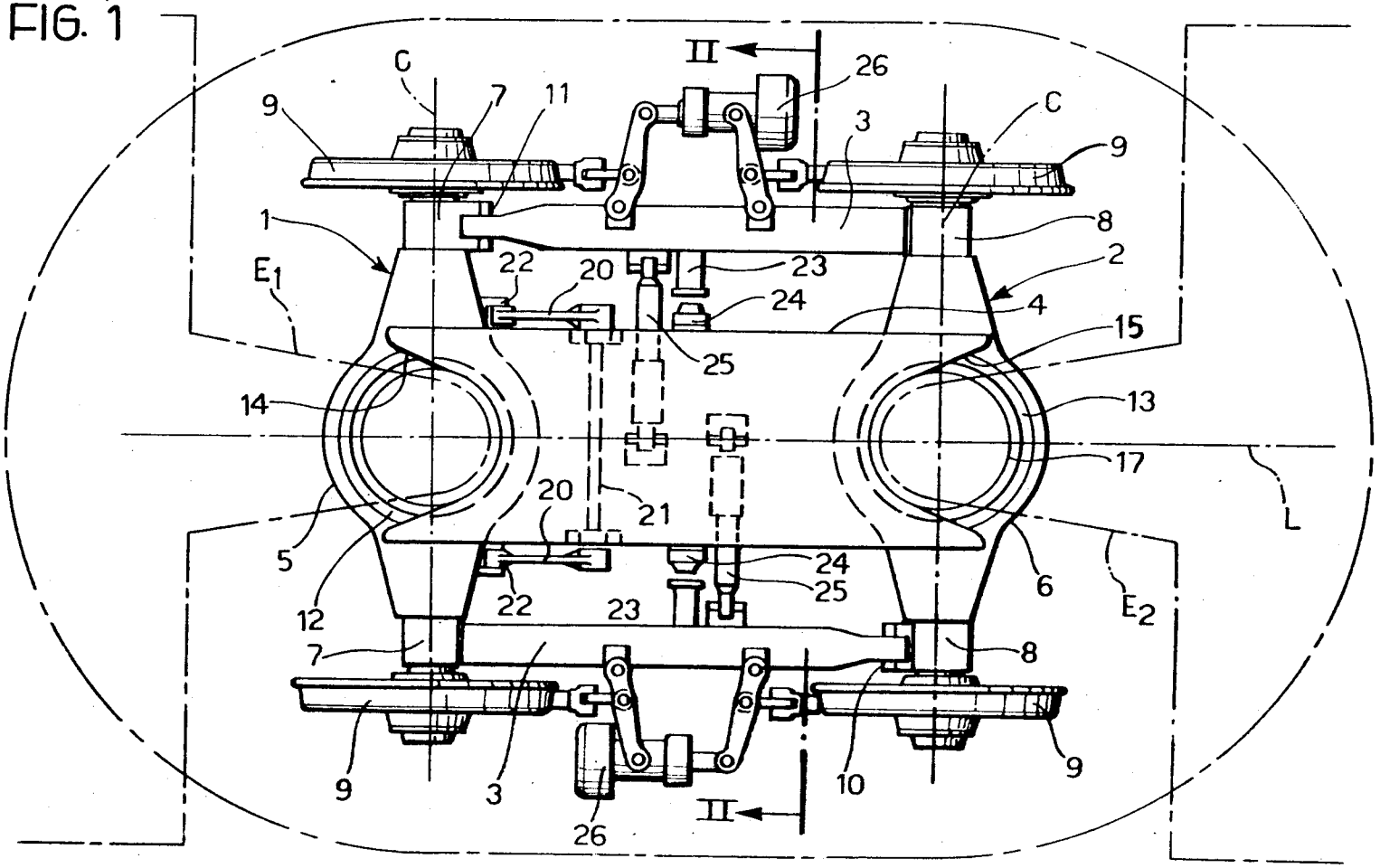
Figure 2:
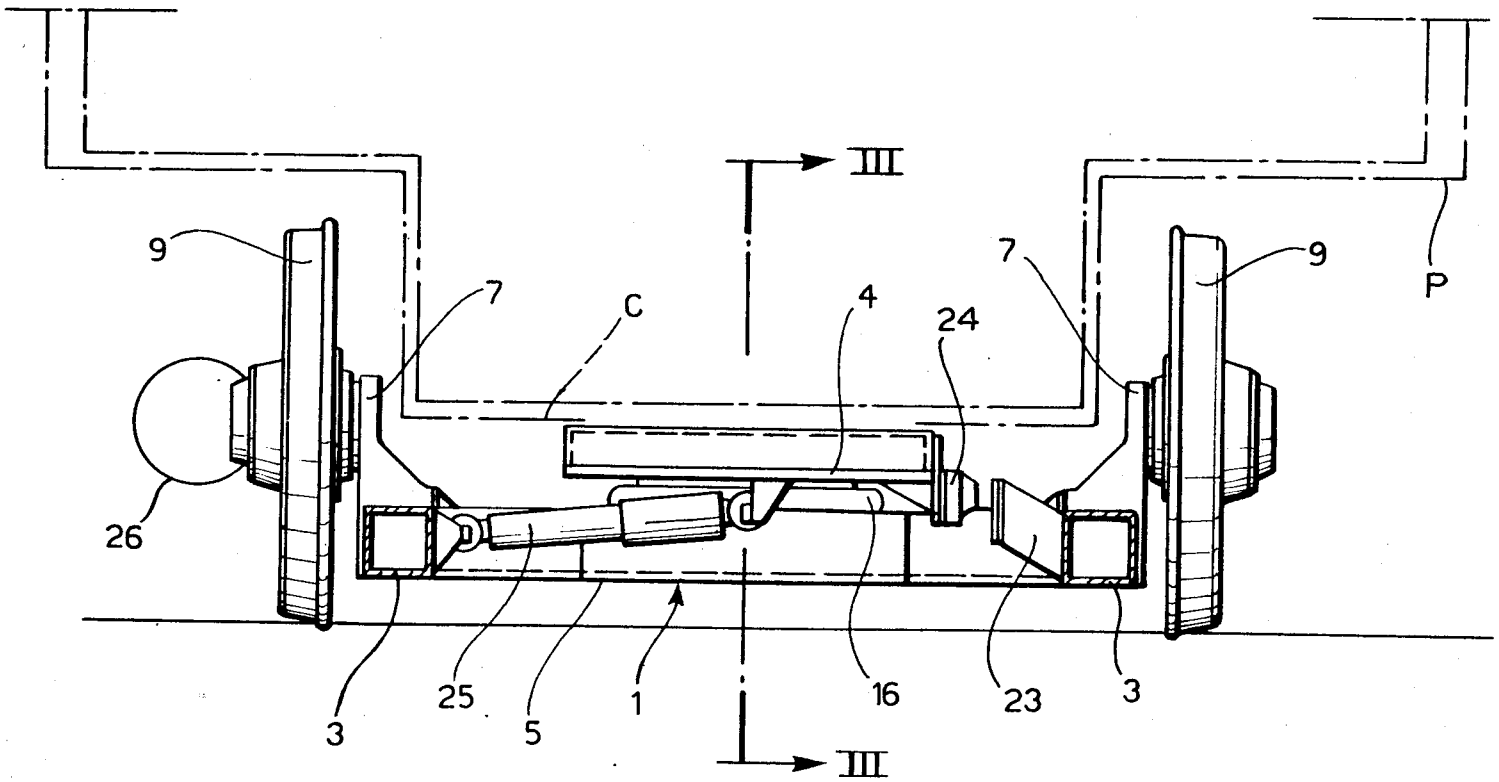
Figure 3:
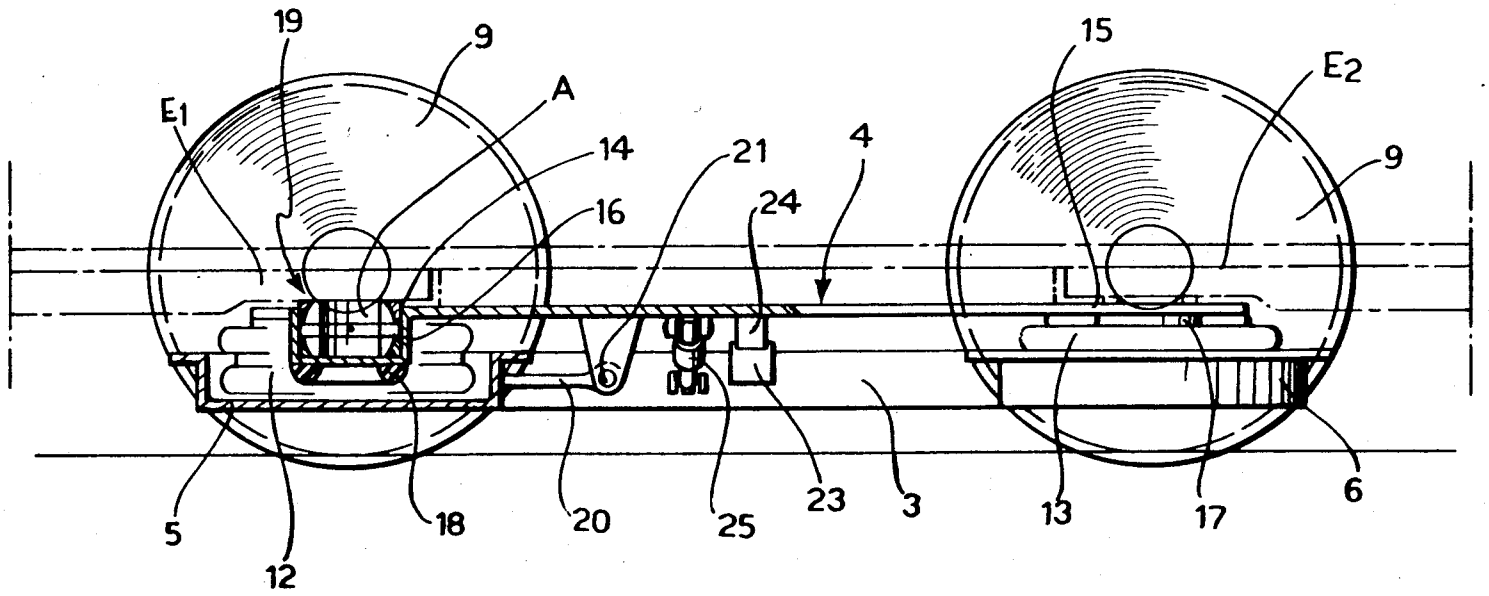

Further characteristics of the invention will become apparent from the detailed description which follows with reference to the appended drawings, provided purely by way of non-limiting example, in which:

FIG. 1 is a schematic plan view from above of a support bogie according to the invention, FIG. 2 is a schematic cross-section taken on the line II—II of FIG. 1, and FIG. 3 is a partially-sectioned longitudinal view taken on the line III—III of FIG. 2.

The bogie illustrated in the drawings is intended to be fitted to the central part of a railway or tramway vehicle with two or more articulated bodies, that is, below the articulation and gangway part between the two bodies. This part is schematically indicated P in FIG. 2, while the articulation ends of the floors of the two bodies are indicated $E_1$, $E_2$ in FIGS. 1 and 3. These articulation ends $E_1$, $E_2$ are provided with respective downwardly projecting, vertical pins A (only one of which is visible in FIG. 3) for their articulated connection to the bogie of the invention, in the manner which will be clarified below.

The bogie consists of two cross-members, generally indicated 1 and 2, two longitudinal members 3 interconnecting the cross members 1 and 2, and a central longitudinal structure 4 which extends above the central zones of the cross members 1 and 2.

As best seen in FIG. 2, each cross member 1, 2 is generally U-shaped with an enlarged, lowered central part forming a support platform 5, 6 and upwardly facing ends 7, 8 carrying four idle wheels 9. The configuration is such that the support platforms 5, 6 lie well below the axles C of the wheels 9, allowing the floor of the vehicle in the central gangway part P to be formed with the configuration illustrated in FIG. 2, that is, with a median lowered part.

The two longitudinal members 3 are constituted by rectangular-sectioned tubular elements and interconnect the two cross members 1 and 2 at the bases of their raised ends 7 and 8, so as to allow relative rotation of these cross members 1 and 2 about the longitudinal axis L of the bogie.

More particularly, one of the longitudinal members 3 is rigidly fixed at one end to one of the end 7 of the cross member 1, while its opposite end is connected to the corresponding end 8 of the other cross member 2 by a ball joint, generally indicated 10. The other longitudinal member 3 is fixed rigidly at one end to the other end 8 of the cross member 2, while its opposite end is connected to the other end 7 of the cross member 1 by means of a similar ball joint, generally indicated 11.

The two support bases 5 and 6 of the cross members 1 and 2 carry two known bellows-type air springs 12, 13 which constitute the secondary transverse and vertical suspension of the bogie.

The central longitudinal structure 4 is constituted by a plate having concave ends 14, 15 which rest on the tops of the air springs 12, 13 and form two holders 16, 17 which project downwardly and are open upwardly.

The two holders 16 and 17, which have a generally cylindrical form, are located coaxially with the springs 12, 13 and extend sealingly through the interiors thereof. Elastic vertical bumper members 18 (only one of which is shown in FIG. 3) are fitted to the outer surfaces of the base walls of the two holders 16, 17 and cooperate with the surfaces of the support platforms 5 and 6 which face them.

Each of the holders 16 and 17 houses a ball-joint coupling unit, generally indicated 19, (only one of which is illustrated in FIG. 3) within which the articulation pin A of the corresponding end $E_1$, $E_2$ of one of the bodies of the vehicle is engaged.

The central longitudinal structure 4 is connected to the cross member 1 by a pair of longitudinal connecting rods 20 articulated at one of their ends to a transverse torsion bar 21 supported beneath the structure 4 at their opposite ends to the sides of the support base 5 by means of ball joints, generally indicated 22. The connecting rods 20 and the torsion bar 21 have the function of preventing longitudinal movements of the central longitudinal structure 4 relative to the cross members 1 and 2, and of keeping it in equilibrium even in the presence of non-barycentric loads.

In order to limit movements of the central structure 4 in a transverse direction, lateral resistance means are provided, which are constituted by two lateral appendages 23 projecting from the inner sides of the two longitudinal members 3 and two elastic bumpers 24 which project from the sides of the structure 4 and cooperate with the appendages 23.

The hydraulic shock-absorbers, indicated 25, are arranged transversely beneath the central longitudinal structure 4 and articulate the middle thereof to the longitudinal members 3, on opposite sides with respect to the appendages 23 of the latter.

The bogie according to the invention is also provided with conventional shoe brake units 26 located in the zones between the wheels 9, as shown in the drawings, or with discs on the wheels or outside them according to known solutions.

Naturally, the principle of the invention remaining the same, the constructional details and the embodiments may be varied widely with respect to that described and illustrated without thereby departing from the scope of the present invention.

I claim:

1. A wheeled bogie for interconnecting adjacent railway vehicles of the type having articulation pins provided on projections at the ends of the vehicles, said bogie comprising:

(a) a longitudinally extending central structure defining a longitudinal axis and having upwardly open articulation sockets adjacent its ends to receive the articulation pins, (b) two cross members, each of which cross members has a central platform below and coaxial with said articulation sockets, (c) annular air springs of the bellows type surrounding said sockets and provided on said central platforms to resiliently support said central structure and to accommodate limited vertical and lateral movement of said central structure relative said cross member platforms, (d) each of said cross members having a shallow U-shape with said central platform defined by the base of the U and with upwardly projecting legs, said legs having upper ends defining supports for the wheels, said wheels provided on two axles in said bogie, (e) longitudinally extending strut members, each of which strut members has one rigidly connected to a lower end of one of said U-shaped cross member legs, said strut members oriented in laterally spaced relationship to said central structure and being independent thereof, each of said strut members having opposite ends pivotably connected to the lower end of each of said U-shaped cross members, (f) means connecting at least one cross member end to said central structure to prevent longitudinal movement of the central structure relative said cross member, said means comprising at least one torsion bar mounted transversely to said central structure and at least one connecting link having one end clamped to the torsion bar and the other end pivotally connected to the cross member, and (g) means for snubbing lateral motion of said central structure relative to said cross members and said longitudinal strut member, said means comprising elastic snubbers provided in part on said central structure and in part on said strut members.

2. A bogie according to claim 1 wherein said articulation sockets in the ends of said central structure are provided below the axes of the rotation of the idler wheels.

3. A bogie according to claim 2 wherein the said central structure provided at least approximately in a horizontal plane defined by said idler wheel axes of rotation.

4. A bogie according to claim 3 wherein said snubbing means further includes fluid damping devices provided in part on said central structure and in part on said longitudinal strut members.

5. A bogie according to claim 4 wherein said upwardly open articulation sockets are more particularly defined by ball joint couplings for said depending articulation pins.

6. A bogie according to claim 5 further characterized by an elastic bumper member associated with the lower end of each socket defining portion and engageable with the central platform portion of said cross member as a result of excessive vertical displacement of the central structure relative said member.

7. A bogie according to claim 6 wherein two parallel connecting links are provided as part of the means for preventing longitudinal motion or movement of the central structure relative the cross member, said second connecting link being clamped to said torsion bar at a point spaced from that at which said first connecting link is clamped, and said second link pivotally connected to said cross member at a point spaced from that at which said first connecting link is so connected to the cross member.

* * * * *